US009114861B2

(12) United States Patent
Kamio

(10) Patent No.: US 9,114,861 B2
(45) **Date of Patent: *Aug. 25, 2015**

(54) PERSONAL WATERCRAFT

(71) Applicant: Kawasaki Jukogyo Kabushiki Kaisha, Kobe-shi, Hyogo (JP)

(72) Inventor: Kunihiko Kamio, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 104 days.

This patent is subject to a terminal disclaimer.

(21) Appl. No.: 13/725,808

(22) Filed: Dec. 21, 2012

(65) Prior Publication Data

US 2014/0030938 A1 Jan. 30, 2014

Related U.S. Application Data

(63) Continuation-in-part of application No. 13/562,186, filed on Jul. 30, 2012.

(51) Int. Cl.

| | |
|---|---|
| ***B63H 21/21*** | (2006.01) |
| ***B63H 11/04*** | (2006.01) |
| ***B63B 35/73*** | (2006.01) |
| ***B63H 11/113*** | (2006.01) |
| ***B63H 11/107*** | (2006.01) |

(52) U.S. Cl.

CPC ..... *B63B 35/731* (2013.01); *B63H 11/04* (2013.01); *B63H 11/107* (2013.01); *B63H 11/113* (2013.01); *B63H 21/21* (2013.01); *B63H 2021/216* (2013.01)

(58) Field of Classification Search

CPC .... B63B 35/731; B63H 11/10; B63H 11/107; B63H 11/113; B63H 21/21; B63H 2011/046; B63H 2021/21; B63H 2021/216; B63H 11/04; B63H 2021/213

USPC ..... 114/55.5, 55.55, 55.57; 440/1, 40–42; 701/21

See application file for complete search history.

(56) References Cited

U.S. PATENT DOCUMENTS

| | | | | |
|---|---|---|---|---|
| 4,022,146 | A * | 5/1977 | Sadler | 440/1 |
| 4,931,025 | A * | 6/1990 | Torigai et al. | 440/1 |
| 4,941,854 | A * | 7/1990 | Takahashi et al. | 440/1 |
| 5,397,890 | A * | 3/1995 | Schueler et al. | 250/221 |
| 5,507,672 | A * | 4/1996 | Imaeda | 440/1 |

(Continued)

FOREIGN PATENT DOCUMENTS

| | | |
|---|---|---|
| JP | 07156878 | 6/1995 |

*Primary Examiner* — Ajay Vasudeva

(74) *Attorney, Agent, or Firm* — Alleman Hall McCoy Russell & Tuttle LLP

(57) ABSTRACT

A personal watercraft is provided which includes a body including a deck and a hull having a water intake on a bottom portion thereof; a water jet pump configured to suction water through the water intake and eject the water through an outlet port of an ejecting nozzle; an engine for actuating the water jet pump; an ejecting direction adjusting device for adjusting an ejecting direction of the water ejected from the water jet pump; a driver seat section provided on the deck and configured to accommodate a driver seated in a straddle state; a passenger seat section provided on the deck behind the driver seat section and configured to accommodate a passenger seated in a straddle state; a sensor for detecting the passenger seated on the passenger seat section; and a controller for controlling the engine to reduce an engine driving power, if the sensor detects the passenger.

18 Claims, 10 Drawing Sheets

(56) References Cited

U.S. PATENT DOCUMENTS

| | | | | |
|---|---|---|---|---|
| 5,683,275 | A * | 11/1997 | Nanami | 440/38 |
| 6,450,845 | B1 * | 9/2002 | Snyder et al. | 440/1 |
| 7,128,014 | B2 * | 10/2006 | Berthiaume et al. | 114/253 |
| 7,163,425 | B2 * | 1/2007 | Kamio | 440/1 |
| 8,000,851 | B2 * | 8/2011 | St-Pierre et al. | 701/21 |
| 2010/0178815 | A1 * | 7/2010 | Leblanc | 440/1 |
| 2014/0030937 | A1 * | 1/2014 | Kamio | 440/1 |

* cited by examiner

PERSONAL WATERCRAFT

CROSS REFERENCE TO RELATED APPLICATIONS

The present application is a continuation-in-part of U.S. patent application Ser. No. 13/562,186 filed Jul. 30, 2012 and entitled PERSONAL WATERCRAFT, the entire disclosure of which is incorporated herein by reference for all purposes.

BACKGROUND OF THE INVENTION

1. Field of the Invention

The present invention generally relates to personal watercraft (PWC). Particularly, the present invention relates to personal watercraft in which plural passengers can ride.

2. Description of the Related Art

Japanese Laid-Open Patent Application Publication No. Hei. 7-156878 discloses an example of a conventional personal watercraft. This personal watercraft includes a water ejecting nozzle, a trim adjusting device for adjusting a vertical inclination angle of the water ejecting nozzle to control a trim angle of a body, a setting device for setting an upper limit value and a lower limit value of the inclination angle of the water ejecting nozzle, and a ship speed detector for detecting a ship speed of the personal watercraft. The trim adjusting device is configured to up-trim or down-trim the water ejecting nozzle based on a detection signal indicating the ship speed from the ship speed detector. The setting device is configured to set the upper limit value and the lower limit value of the inclination angle of the water ejecting nozzle to proper values according to the number of passengers riding on the personal watercraft. In this personal watercraft, when the inclination angle of the water ejecting nozzle is set to a value between the upper limit value and the lower limit value, the water ejecting nozzle is merely up-trimmed or down-trimmed irrespective of the number of passengers riding on the personal watercraft. Because of this, in a case where plural passengers ride on the personal watercraft rather than a single passenger, they cannot enjoy a favorable attitude of a body of the personal watercraft.

SUMMARY OF THE INVENTION

Accordingly, an object of the present invention is to provide a favorable attitude of the body of the personal watercraft when passenger(s) is/are riding on the personal watercraft.

According to one aspect of the present invention, a personal watercraft of the present invention comprises a body including a hull and a deck covering the hull from above, the hull having a water intake on a bottom portion thereof; a water jet pump including an ejecting nozzle, the water jet pump being configured to suction water through the water intake and eject the water through an outlet port of the ejecting nozzle; an engine for actuating the water jet pump; an ejecting direction adjusting device for adjusting an ejecting direction of the water ejected from the water jet pump; a driver seat section provided on the deck and configured to accommodate a driver seated on and straddling the driver seat section; a passenger seat section provided on the deck in a location behind the driver seat section, the passenger seat section being configured to accommodate a passenger seated on and straddling the passenger seat section; a sensor for detecting whether the passenger is seated on the passenger seat section; and a controller for controlling the engine; wherein the controller is configured to control the engine to reduce a driving power of the engine, if the sensor detects that the passenger is seated on the passenger seat section.

In this configuration, when the sensor detects that the passenger is seated on the passenger seat section, the control system controls the engine to reduce the driving power of the engine. This can automatically reduce speed and acceleration of the personal watercraft, and provide a favorable attitude of the body of the personal watercraft when the passenger is riding on the personal watercraft, without the driver's operation.

According to another aspect of the present invention, a personal watercraft comprises a body including a hull and a deck covering the hull from above, the hull having a water intake on a bottom portion thereof; a water jet pump including an ejecting nozzle, the water jet pump being configured to suction water through the water intake and eject the water through an outlet port of the ejecting nozzle; an engine for actuating the water jet pump; an ejecting direction adjusting device for adjusting an ejecting direction of the water ejected from the water jet pump; a driver seat section provided on the deck and configured to accommodate a driver seated on and straddling the driver seat section; a passenger seat section provided on the deck in a location behind the driver seat section, the passenger seat section being configured to accommodate a passenger seated on and straddling the passenger seat section; a sensor for detecting the passenger seated on the passenger seat section; and a controller for controlling the ejecting direction adjusting device; wherein the controller is configured to control the ejecting direction adjusting device such that the outlet port faces in an obliquely downward direction, if the sensor detects that the passenger is seated on the passenger seat section.

In this configuration, when the sensor detects that the passenger is seated on the passenger seat section, the control system controls the ejecting direction adjusting device such that the outlet port of the ejecting nozzle faces in the obliquely downward direction. This can automatically suppress a front portion of the personal watercraft from being raised, and provide a favorable attitude of the body of the personal watercraft when the passenger is riding on the personal watercraft, without the driver's operation.

The above and further objects, features and advantages of the invention will more fully be apparent from the following detailed description with reference to the accompanying drawings.

DETAILED DESCRIPTION OF THE PREFERRED EMBODIMENTS

Hereinafter, an embodiment of the present invention will be described with reference to the drawings. The stated directions are referenced from the perspective of a driver riding on a personal watercraft.

Figure 1:
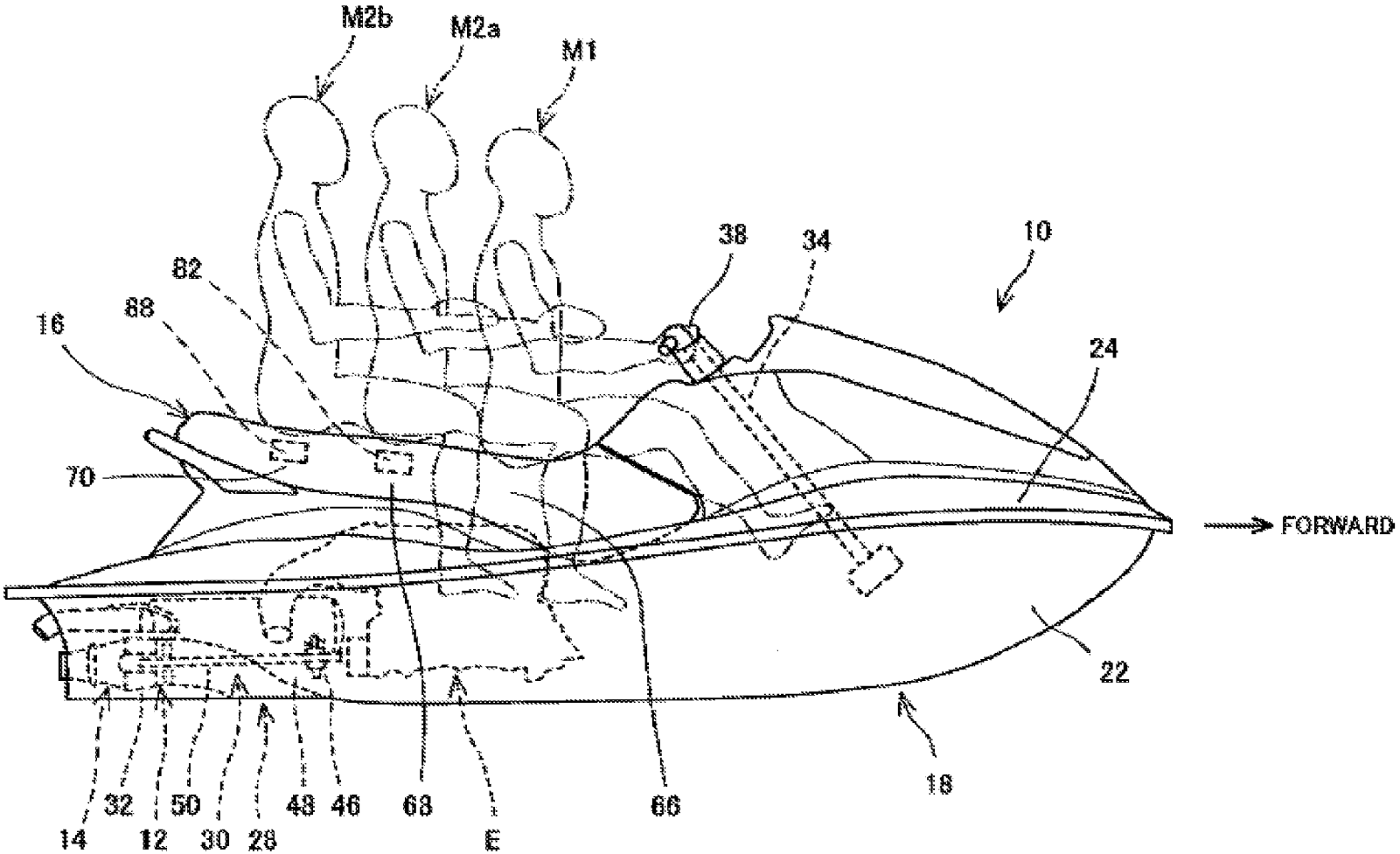
FIG. 1 is a side view showing an external appearance of personal watercraft according to an embodiment of the present invention.
Figure 2:
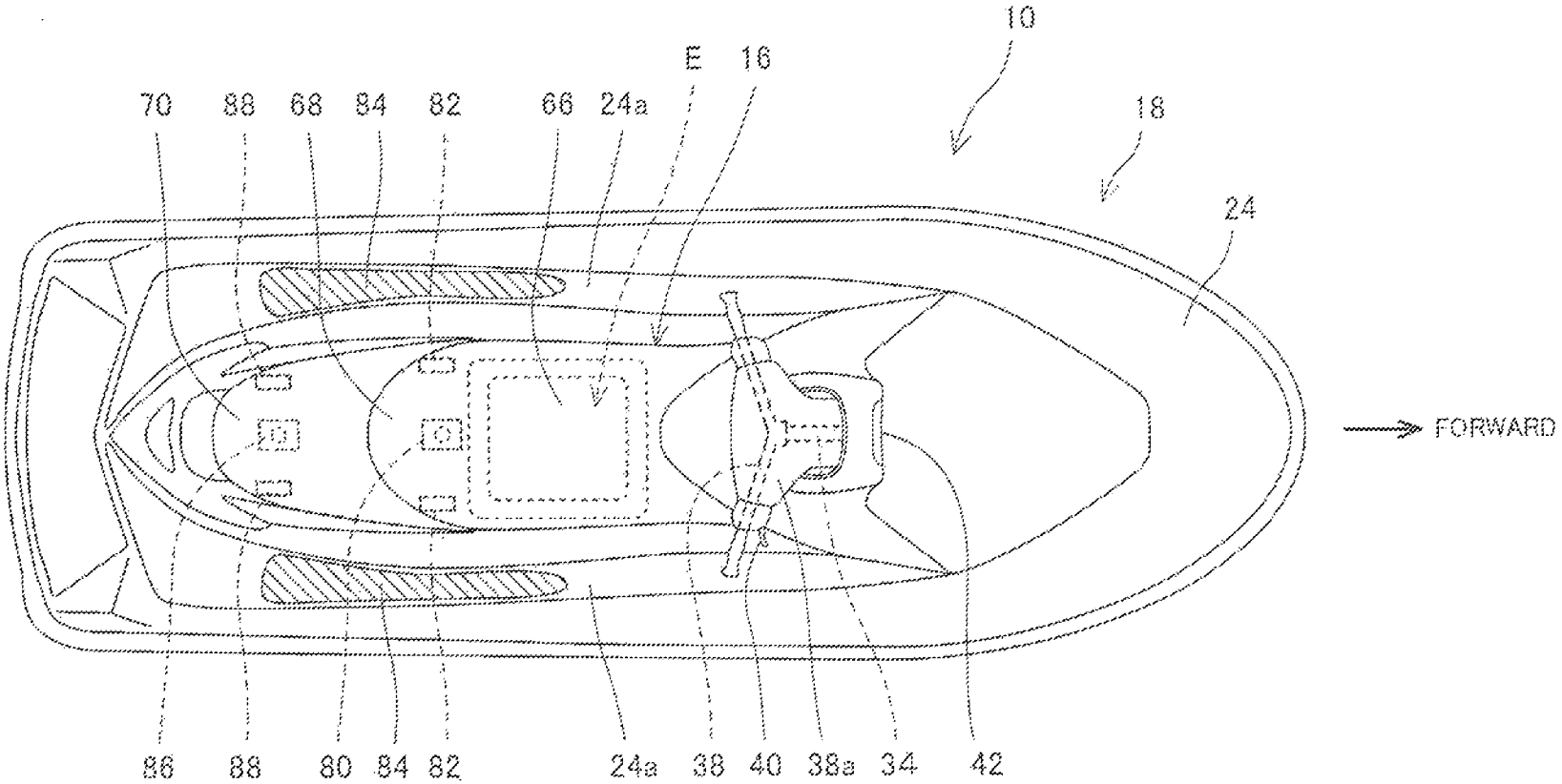
FIG. 2 is a plan view showing the external appearance of the personal watercraft.
Figure 3:
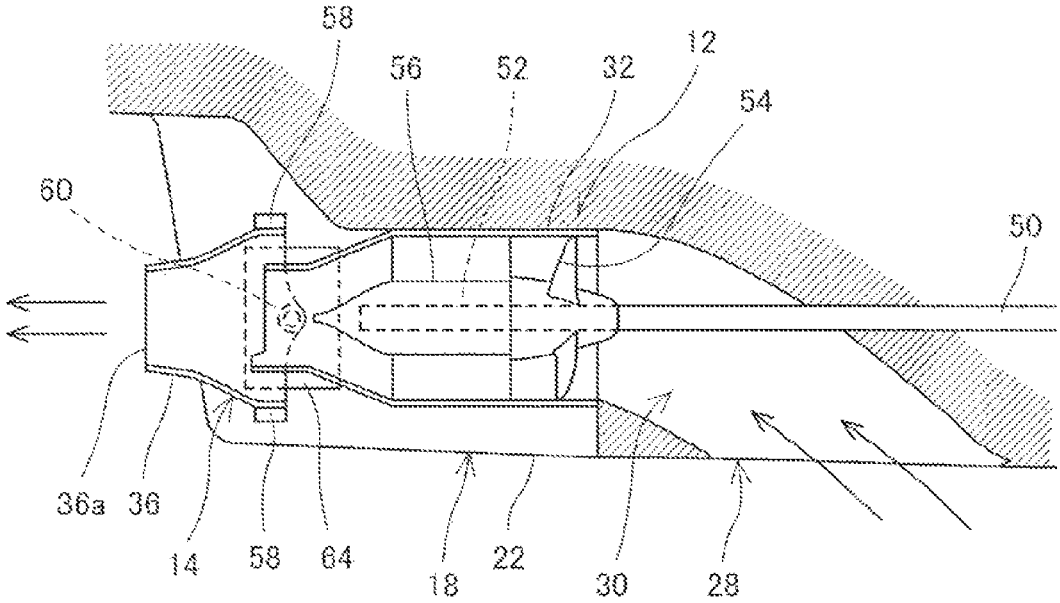
FIG. 3 is a side view showing a configuration of a water jet pump of the personal watercraft.
Figure 4:
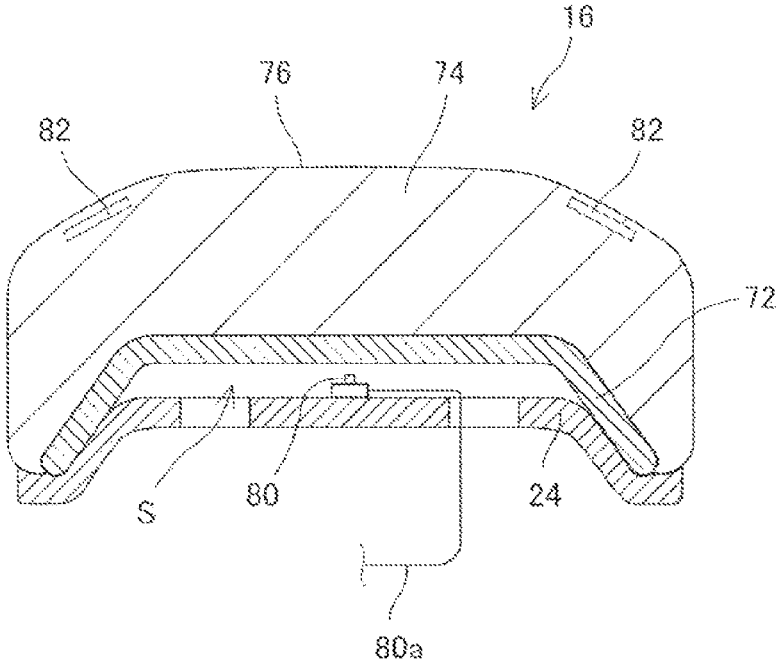
FIG. 4 is a cross-sectional view showing a configuration of a seat of the personal watercraft.
Figure 5:
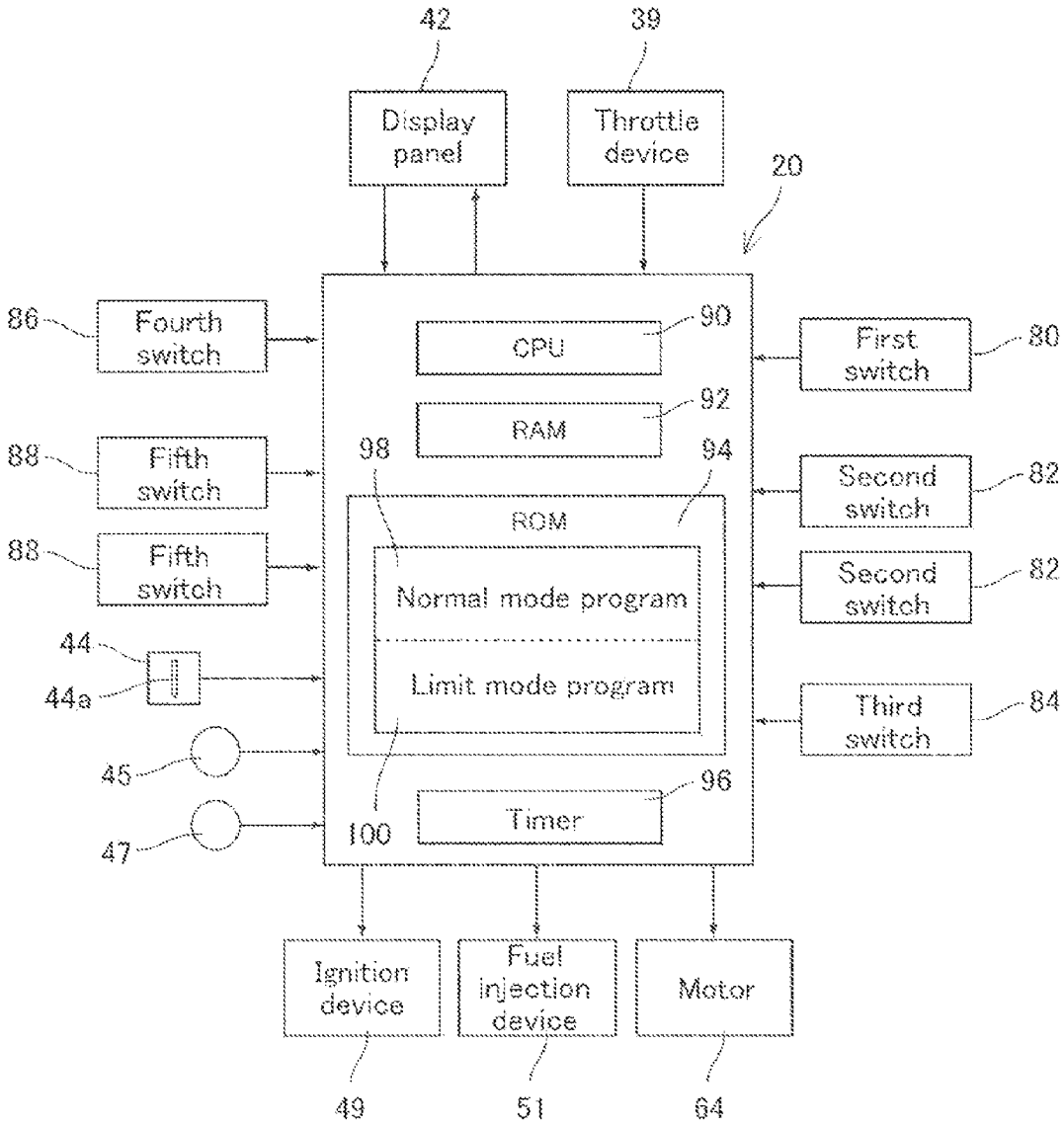
FIG. 5 is a block diagram showing a configuration of a control system in the personal watercraft.

FIG. 1 is a side view showing an external appearance of a personal watercraft 10 according to an embodiment of the present invention. FIG. 2 is a plan view showing the external appearance of the personal watercraft 10. FIG. 3 is a side view showing a configuration of a water jet pump 12 of the personal watercraft 10. FIG. 4 is a cross-sectional view showing a configuration of a seat 16 of the personal watercraft 10. FIG. 5 is a block diagram showing a configuration of a control system 20 in the personal watercraft 10.

Referring to FIG. 1, the personal watercraft (hereinafter referred to as the watercraft) 10 is a straddle-type watercraft in which the driver and passenger(s) ride, straddling the seat 16. The watercraft 10 includes a body 18, a water jet pump 12 disposed at a rear portion of the body 18, an engine E for actuating the water jet pump 12, an ejecting direction adjusting device 14 for adjusting an ejecting direction of a water jet ejected from the water jet pump 12, and a seat 16 on which a driver M1, and passengers M2*a*, M2*b* are seated in a straddle state. As shown in FIG. 5, the watercraft 10 includes a control system 20 for controlling operation of the watercraft 10.

As shown in FIG. 1, the body 18 includes a hull 22 and a deck 24 covering the hull 22 from above. The engine E is placed inside of the body 18. A water intake 28 for suctioning water from outside and a water guide passage 30 for guiding the suctioned water in a rearward direction are provided on a bottom portion of the hull 22. Behind the water guide passage 30, a pump casing 32 is provided.

Referring to FIG. 2, the seat 16 is mounted to a substantially center portion of the deck 24. In front of the seat 16, a steering shaft 34 penetrates the deck 24 and extends substantially vertically. A handle 38 is attached to an upper end portion of the steering shaft 34. A throttle lever 40 is attached to the handle 38 to manipulate a throttle device 39 (FIG. 5). A display panel 42 (FIG. 5), a main switch 44 (FIG. 5), and other components are attached on a handle cover 38*a*. A starter switch 45 (FIG. 5), a kill switch 47 (FIG. 5), and other components are attached on the handle 38.

Referring to FIG. 5, an electric circuit of the throttle device 39, an electric circuit of the display panel 42, an electric circuit of the main switch 44, an electric circuit of the starter switch 45, and an electric circuit of the kill switch 47 are electrically connected to the control system 20. The display panel 42 is configured to display information such as cruising speed, fuel amount, and driving mode. The main switch 44 is turned ON to apply a current to an electric system including an ignition device 49 and a fuel injection device 51, or turned OFF to stop applying a current to the electric system. The main switch 44 has, for example, a keyhole 44*a* into which a key (not shown) is inserted. When the key is inserted into the keyhole 44*a*, an immobilizer provided on the key communicates with the control system 20. When the key is a registered key, the control system 20 turns ON the main switch 44. Note that the main switch 44 may be a press-button switch or an electronic key.

The starter switch 45 is a press-button switch. When the starter switch 45 is pressed, a starting motor (not shown) of the engine E (FIG. 1) is actuated to start the engine E. The kill switch 47 is a press-button switch. The kill switch 47 is attached with one end of a tether cord. When the kill switch 47 is pressed, or the tether cord is pulled out, current application to the ignition device 49 and to the fuel injection device 51 is stopped, and the engine E (FIG. 1) is stopped.

As shown in FIG. 1, the engine E includes a crankshaft 46 extending in a forward and rearward direction. A rear end portion of the crankshaft 46 is coupled to a front end portion of a propeller shaft 50 via a coupling member 48. In the present embodiment, the engine E is an in-line four-cylinder four-cycle engine.

As shown in FIG. 3, the water jet pump 12 includes the pump casing 32 disposed at a rear portion of the body 18, a pump shaft 52 disposed inside of the pump casing 32, an impeller 54 attached on the pump shaft 52, a support mechanism 56 for supporting the pump shaft 52 such that the pump shaft 52 is rotatable, and an ejecting nozzle 36 disposed behind the pump casing 32. A front end portion of the pump shaft 52 is coupled to a rear end portion of the propeller shaft 50. Water is suctioned through the water intake 28 provided on the bottom portion of the hull 22 and guided to the water jet pump 12 through the water guide passage 30. The water jet pump 12 causes the impeller 54 to pressurize and accelerate the water, and then ejects the water from an outlet port 36*a* at a rear end of the ejecting nozzle 36 through the ejecting nozzle 36. As the resulting reaction, the watercraft 10 attains a propulsive force for moving the body 18.

As shown in FIG. 3, an ejecting direction adjusting device 14 includes a first support mechanism 58 for supporting the ejecting nozzle 36 such that the ejecting nozzle 36 is pivotable to the right or to the left in response to a motion of the handle 38 (FIG. 2), and a second support mechanism 60 for supporting the ejecting nozzle 36 such that the ejecting nozzle 36 is vertically pivotable. The ejecting direction adjusting device 14 further includes a motor 64 which causes the ejecting nozzle 36 to be vertically pivotable. As shown in FIG. 5, an electric circuit of the motor 64 is electrically connected to the control system 20. The motor 64 is controlled in accordance with a control signal provided by the control system 20. When the motor 64 is rotated in one direction in response to the control signal from the control system 20, the ejecting nozzle 36 is pivoted downward (or upward) to direct the outlet port 36*a* downward (or upward). When the motor 64 is rotated in an opposite direction in response to the control signal from the control system 20, the ejecting nozzle 36 is pivoted upward (or downward) to direct the outlet port 36*a* upward (or downward). An inclination angle $\alpha$ (FIG. 10) of the ejecting nozzle 36 can be adjusted by controlling a rotational angle of the motor 64 by the control system 20.

A cable (not shown) is coupled at one end portion thereof to a lower end portion of the steering shaft 34 (FIG. 2) and coupled at the other end portion thereof to a side portion of the ejecting nozzle 36 of FIG. 3. When the handle 38 (FIG. 2) is moved to the right or to the left, the steering shaft 34 is rotated to the right or to the left, and the ejecting nozzle 36 is pivoted to the right or to the left in response to the rotation of the steering shaft 34. Thus, when the handle 38 (FIG. 2) is moved while the water jet pump 12 is generating the propulsive force, the ejecting direction of the water jet ejected from the ejecting nozzle 36 can be changed, and hence the watercraft 10 can change its moving direction.

As shown in FIG. 1, the seat 16 includes a first seat section 66 which is mounted to the deck 24 and on which the driver M1 is seated in a straddle state, a second seat section 68 which is mounted to the deck 24 in a location behind the first seat section 66 and on which the passenger M2*a* is seated in a straddle state, and a third seat section 70 which is mounted to the deck 24 in a location behind the second seat section 68 and on which the passenger M2*b* is seated in a straddle state. In the present embodiment, the first seat section 66, the second seat section 68 and the third seat section 70 have a unitary structure. In other words, each of the first seat section 66, the second seat section 68 and the third seat section 70 constitutes a portion of the seat 16. That is, the first seat section 66 is a "driver seat section" on which the driver M1 is seated in a straddle state. The second seat section 68 and the third seat section 70 are "passenger seat sections" on which the passengers M2*a*, M2*b* are seated in a straddle state, respectively.

As shown in FIG. 4, each of the first seat section 66 (FIG. 1), the second seat section 68 (FIG. 1) and the third seat section 70 (FIG. 1), constituting the seat 16, includes a base member 72 (seat bottom section) removably mounted to the deck 24, a seat body 74 (cushion member) attached on the base member 72, and a cover section 76 for covering an obverse surface of the seat body 74. The base member 72, corresponding to at least the second seat section 68 (FIG. 1) and the third seat section 70 (FIG. 1), has a substantially arch shape to be spaced apart from the deck 24. Thus, a space S is formed between the base member 72 and the deck 24.

Figure 6:
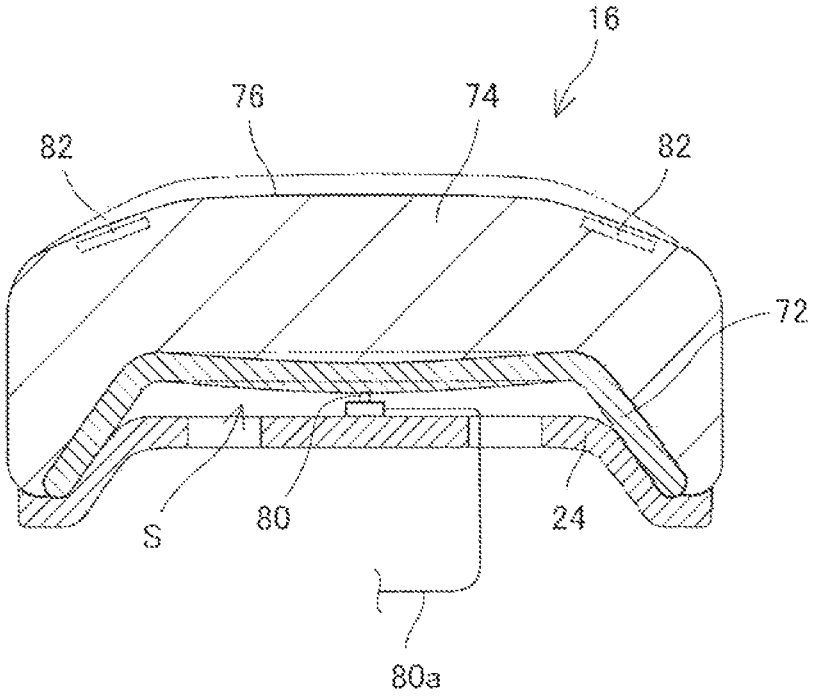
FIG. 6 is a cross-sectional view showing a state in which the seat is deformed by the weight of passenger(s) riding on the personal watercraft.

FIG. 6 is a cross-sectional view showing a state in which the seat 16 is deformed by the weight of one or both of the passengers M2*a*, M2*b* (FIG. 1). When the second seat section 68 (FIG. 1) and the third seat section 70 (FIG. 1) are subjected to the weight of the passengers M2*a*, M2*b*, the base member 72 is deformed to protrude downward as shown in FIG. 6.

As shown in FIG. 2, the watercraft 10 further includes a first switch 80, second switches 82, third switches 84, a fourth switch 86 and fifth switches 88. As shown in FIG. 5, electric circuits of the switches 80, 82, 84, 86, 88 are electrically connected to the control system 20 via signal wires (not shown), or communicatively coupled to the control system 20 via a radio (wireless) communication device (not shown).

The first switch 80 functions as a sensor for detecting the passenger M2*a* (FIG. 1) seated on the second seat section 68. As shown in FIG. 4, the first switch 80 is positioned between the deck 24 and the second seat section 68 to detect that the second seat section 68 is deformed by the weight of the passenger M2*a* (FIG. 1). More specifically, the first switch 80 is attached on the upper surface of the deck 24 such that the first switch 80 is positioned in a space S formed under the second seat section 68. In a state in which the passenger M2*a* (FIG. 1) is not seated on the second seat section 68, there is a distance between the base member 72 of the second seat section 68 and the first switch 80. Therefore, the first switch 80 is not activated. When the passenger M2*a* (FIG. 1) is seated on the second seat section 68, the base member 72 of the second seat section 68 is deformed such that it protrudes downward by the weight of the passenger M2*a*, and contacts the first switch 80, causing the first switch 80 to be activated to output a detection signal. Based on the detection signal received from the first switch 80, the control system 20 (FIG. 5) determines that the passenger M2*a* is riding on the watercraft 10. As shown in FIG. 4, in a case where the first switch 80 and the control system 20 are electrically coupled to each other via a signal wire 80*a*, the signal wire 80*a* is laid out away from the seat 16. Therefore, the signal wire 80*a* will not become an obstruction when the seat 16 is detached.

The second switches 82 function as sensors for detecting the passenger M2*a* (FIG. 1) seated on the second seat section 68. Each of the second switches 82 is a pressure-sensitive switch (pressure-sensitive sensor) activated in response to a pressure applied from the passenger M2*a* to the second switch 82. As shown in FIG. 4, the second switches 82 are provided along the cover section 76 of the second seat section 68. In a state in which the passenger M2*a* (FIG. 1) is not seated on the second seat section 68, each of the second switches 82 is not applied with the pressure applied from the passenger M2*a* and is not activated. In a state in which the passenger M2*a* (FIG. 1) is seated on the second seat section 68, each of the second switches 82 is applied with the pressure applied from the passenger M2*a* and is activated to output a signal. Receiving the signal from each of the second switches 82, the control system 20 (FIG. 5) determines that the passenger M2*a* is riding on the watercraft 10.

The third switches 84 function as sensors for detecting the passenger M2*a* (FIG. 1) seated on the second seat section 68 and the passenger M2*b* (FIG. 1) seated on the third seat section 70. Each of the third switches 84 is a pressure-sensitive switch (pressure-sensitive sensor) activated in response to a pressure applied by the passenger M2*a*, M2*b* (FIG. 1) to the third switch 84. As shown in FIG. 2, the third switches 84 have a shape elongated in the forward and rearward direction and being thin, and are provided on step sections 24*a* on the upper surface of the deck 24, on which feet of the passengers M2*a*, M2*b* are rest. In a state in which the feet of the passengers M2*a*, M2*b* are not resting on the third switches 84, each of the third switches 84 is not applied with the pressures from the passengers M2*a*, M2*b* and is not activated. On the other hand, in a state in which the feet of the passengers M2*a*, M2*b* are rest on the third switches 84, each of the third switches 84 is applied with the pressures from the passengers M2*a*, M2*b* and is activated to output a detection signal. Based on the detection signal received from each of the third switches 84, the control system (FIG. 5) determines that one or both of the passengers M2*a*, M2*b* (FIG. 1) is/are riding on the watercraft 10.

The fourth switch 86 functions as a sensor for detecting the passenger M2*b* (FIG. 1) seated on the third seat section 70. The fourth switch 86 is configured like the first switch 80 of FIGS. 4 and 6, and is attached on the upper surface of the deck 24 such that it is positioned in a space (not shown) formed under the third seat section 70.

The fifth switches 88 function as sensors for detecting the passenger M2*b* (FIG. 1) seated on the third seat section 70. The fifth switches 88 are configured like the second switches 82 of FIGS. 4 and 6 and are provided inside of the cover section 76 of the third seat section 70.

Referring to FIG. 5, the control system 20 includes a CPU 90, RAM 92, ROM 94, a timer 96, etc. The CPU 90 executes calculation based on programs and data stored in the ROM 94 and outputs data derived by the calculation. The data from the CPU 90, data externally input, and other data are temporarily stored in the RAM 92. A normal mode program 98 corresponding to a normal mode, a limit mode program 100 corresponding to a limit mode, etc., are stored in the ROM 94. The timer 96 counts time that passes from a particular time point. For example, the timer 96 counts the time (idling time) that passes from a time point when a throttle valve (shown) of the throttle device 39 is closed, etc. The throttle valve is closed in a state in which the throttle lever 40 (FIG. 2) is not operated.

To drive the watercraft 10, initially, the driver M1 (FIG. 1) inserts the key (not shown) into the keyhole 44*a* of the main switch 44 of FIG. 5, to apply a current to the electric system. Then, the driver presses the starter switch 45 of FIG. 5 to start the engine E (FIG. 1). To stop running of the engine E, the driver presses the kill switch 47 of FIG. 5 or pulls out the tether cord (not shown).

Hereinafter, the operation of the watercraft 10 controlled by the control system 20 will be described with reference to the flowcharts of FIGS. 7 and 8. When the main switch 44 of FIG. 5 is turned ON, it is determined whether or not the engine E has been started in step S1. If it is determined as NO in step S1, the watercraft 10 is placed in a stand-by state. On the other hand, if it is determined as YES in step S1, the process goes to step S3. In step S3, it is determined whether or not at least one of the first switch 80 of FIG. 2, the second switches 82 of FIG. 2, the third switches 84 of FIG. 2, the fourth switch 86 of FIG. 2 and the fifth switches 88 of FIG. 2 is in an ON-state. In other words, it is determined whether or not the passenger M2*a* or M2*b* (FIG. 1) is riding on the watercraft 10.

If it is determined as NO in step S3, the process goes to step S5, and a normal mode operation based on the normal mode program 98 of FIG. 5 is executed. In the normal mode operation, driving power of the engine E of FIG. 1 is not limited and the inclination angle α (FIG. 10) of the ejecting nozzle 36 is not limited. In step S7, it is determined whether or not the engine E is stopped in the middle of the normal mode operation. If it is determined as NO in step S7, the process returns to step S3, whereas if it is determined as YES in step S7, the process goes to step S9. In the present embodiment, the normal mode is selected in an initial state, and the normal mode operation is continued before one of the switches 80 to 88 (FIG. 2) is turned ON.

On the other hand, if it is determined as YES in step S3, i.e., at least one of the switches 80 to 88 (FIG. 2) is in an ON-state, the process goes to step S11, and the limit mode operation based on the limit mode program 100 of FIG. 5 is executed.

Figure 8:
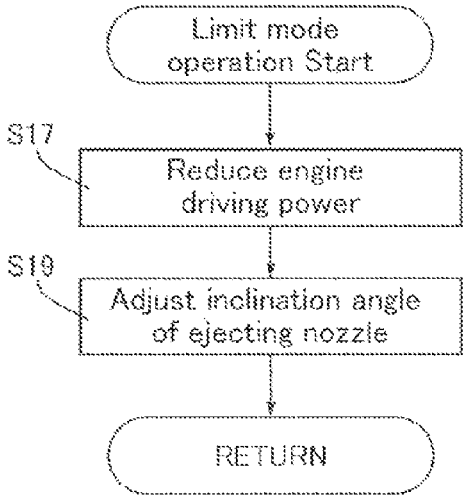
FIG. 8 is a flowchart showing operation of the personal watercraft in a limit mode operation.
Figure 9:
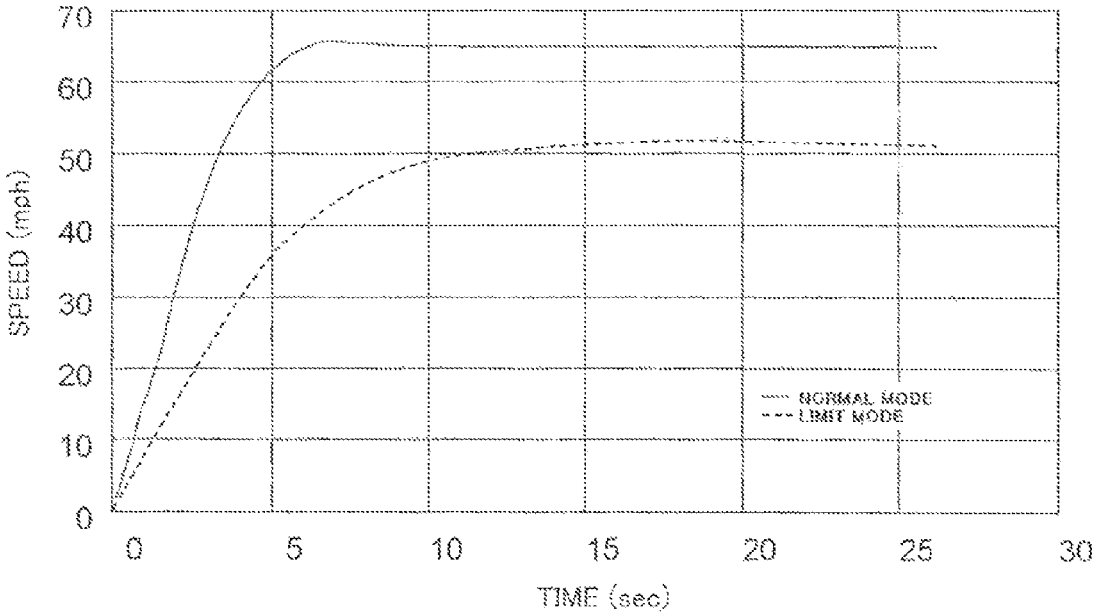
FIG. 9 is a graph showing a relationship between a time and a speed in a case where the personal watercraft is operated.

As shown in FIG. 8, in the limit mode operation, in step S17, the control system 20 controls the engine E (FIG. 1) to reduce the driving power of the engine E. Specifically, the control system 20 controls the fuel injection device 51 of FIG. 5, and other devices, to reduce a fuel injection amount, thereby reducing the driving power of the engine E. FIG. 9 is a graph showing a relationship between time and speed in a case where the watercraft 10 is operated. As can be seen from FIG. 9, in the limit mode operation, a maximum speed and acceleration can be made lower those that in the normal mode operation. As the method of reducing the driving power of the engine E (FIG. 1), in addition to the above method of reducing the fuel injection amount, there may be used a method of advancing or retarding a timing of the fuel injection, a method of advancing or retarding an ignition timing, or a method of suitably combining these.

Figure 10:
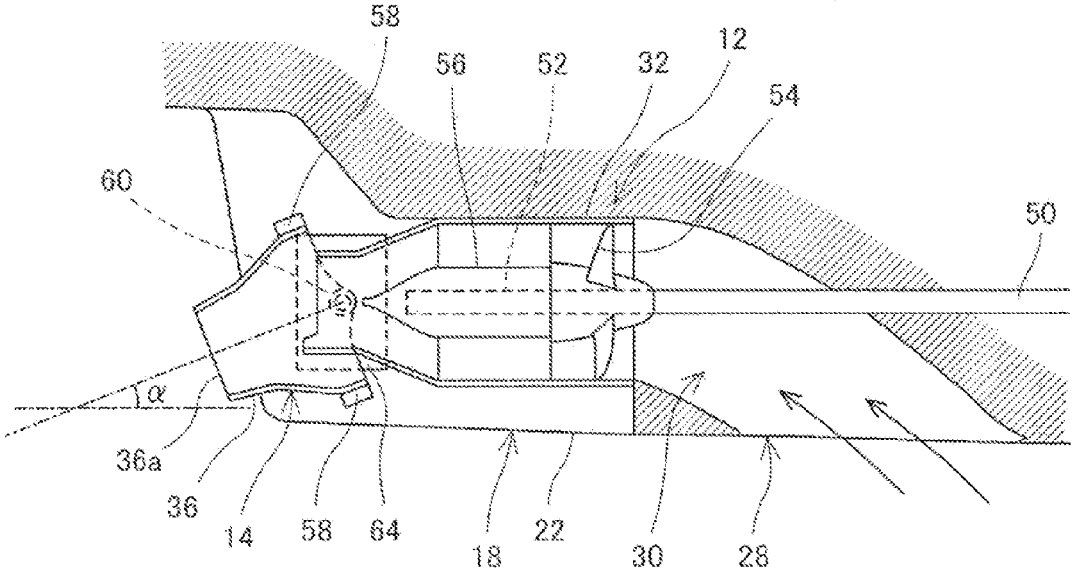
FIG. 10 is a side view showing a state of an ejecting nozzle in the limit mode operation.

In the limit mode operation of FIG. 8, in step S19, the control system 20 controls the ejecting direction adjusting device 14 such that the outlet port 36*a* (FIG. 3) of the ejecting nozzle 36 faces in an obliquely downward direction. FIG. 10 is a side view showing a state of the ejecting nozzle 36 in the limit mode operation. In the limit mode operation, the inclination angle α of the ejecting nozzle 36 with respect to a horizontal plane is limited to a range of, for example, 10 to 80 degrees. Therefore, in the limit mode operation, the front portion of the body 18 is suppressed from being raised, as compared to the normal mode operation.

Figure 7:
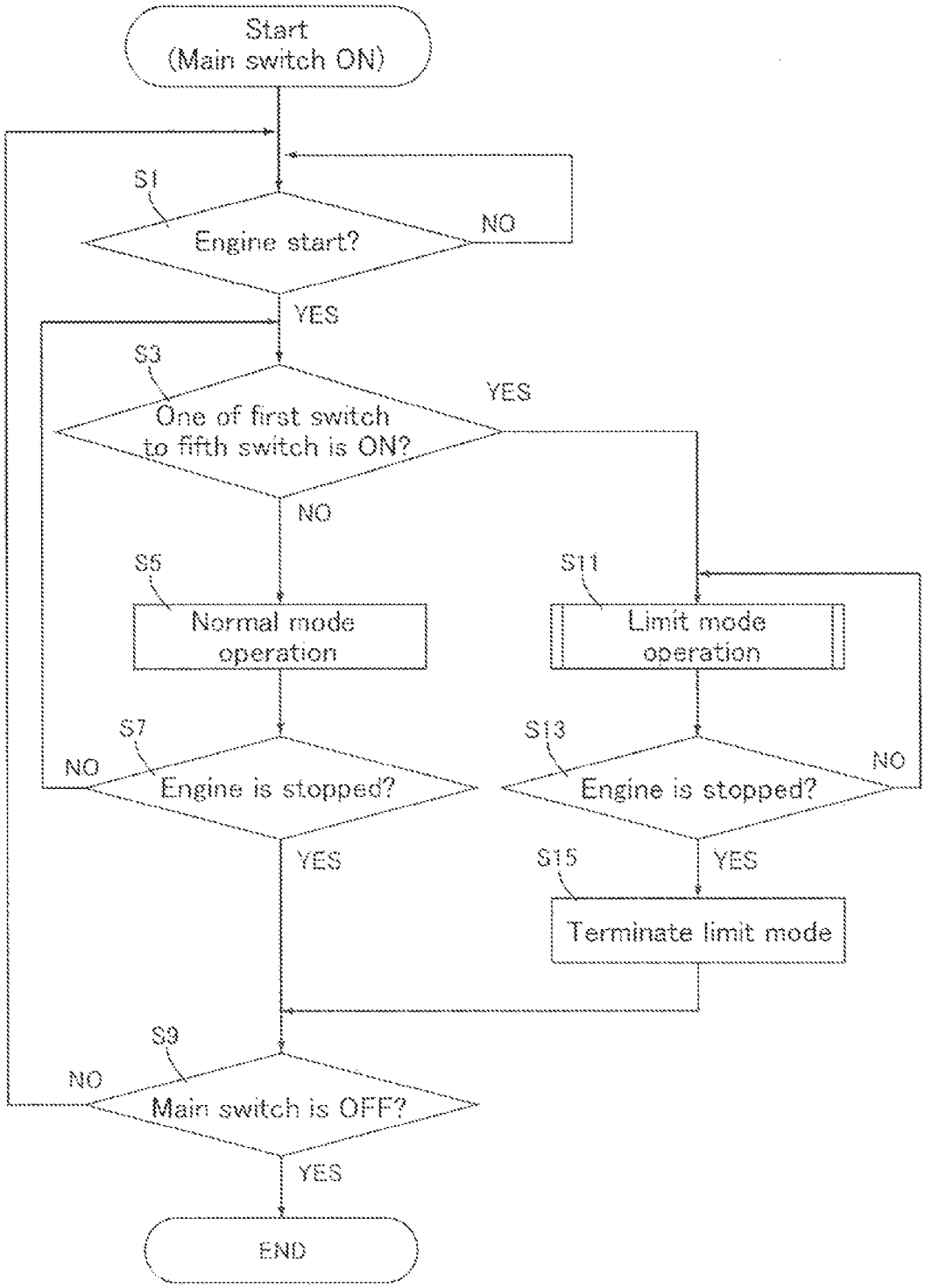
FIG. 7 is a flowchart showing operation of the personal watercraft controlled by the control system.

In step S13 of FIG. 7, it is determined whether or not the engine E is stopped in the middle of the limit mode operation. If it is determined as NO in step S13, the limit mode operation is continued, whereas if it is determined as YES in step S13, the limit mode is terminated in step S15. That is, the limit mode is maintained during a period of time that passes until it is determined as YES in step S13, even if all of the switches 80 to 88 (FIG. 2) are in OFF-states.

In accordance with the present embodiment, the following advantages are achieved. When at least one of the switches 80 to 88 (FIG. 2) detects the passenger M2*a*, M2*b* (FIG. 1), the control system 20 (FIG. 5) controls the engine E (FIG. 2) to reduce the driving power of the engine E. Therefore, the driving state of the watercraft 10 can be stabilized automatically, and the passenger can enjoy a favorable attitude of the body 18.

When at least one of the switches 80 to 88 (FIG. 2) detects the passenger M2*a*, M2*b* (FIG. 1), the control system 20 (FIG. 5) controls the ejecting direction adjusting device 14 such that the outlet port 36*a* of the ejecting nozzle 36 faces in the obliquely downward direction as shown in FIG. 10. This makes it possible to automatically suppress the front portion of the body 18 (FIG. 1) from being raised. In this way, the passenger can enjoy a favorable attitude of the body 18 of the watercraft 10.

As shown in FIG. 2, since the first switch 80, the third switches 84 and the fourth switch 86 are attached on the deck 24, the passengers M2*a*, M2*b* (FIG. 1) seated on the second seat section 68 and the third seat section 70 do not contact the switches 80, 84, 86, and therefore do not feel discomfort. In addition, since signal wires connected to the switches 80, 84, 86 are laid out away from the seat 16, they are not cut when the seat 16 is mounted to or removed from the deck 24. Also, the signal wires do not become an obstruction when the seat 16 is removed from the deck 24.

As shown in steps S11 to S15 of FIG. 7, the limit mode operation is continued during a period of time that passes until the control system 20 (FIG. 5) terminates the limit mode. In other words, even when the passengers M2*a*, M2*b* (FIG. 1) are away from the seat 16 for a moment and the switches 80 to 88 (FIG. 2) do not detect the passengers M2*a*, M2*b* (FIG. 1), the limit mode does not shift to the normal mode. This makes it possible to suppress the driving state of the watercraft 10 from shifting frequently, and provide a favorable attitude of the body 18.

Although in the present embodiment, the control system 20 (FIG. 5) terminates the limit mode when the engine E (FIG. 1) is stopped, another configuration or method may be used to terminate the limit mode. For example, the control system 20 (FIG. 5) may terminate the limit mode, in response to OFF of the main switch 44 (FIG. 5). Or, as shown in step S21 and step S23 of FIG. 11, the control system 20 (FIG. 5) may terminate the limit mode, if the idling time is longer than a predetermined time "t."

Figure 11:
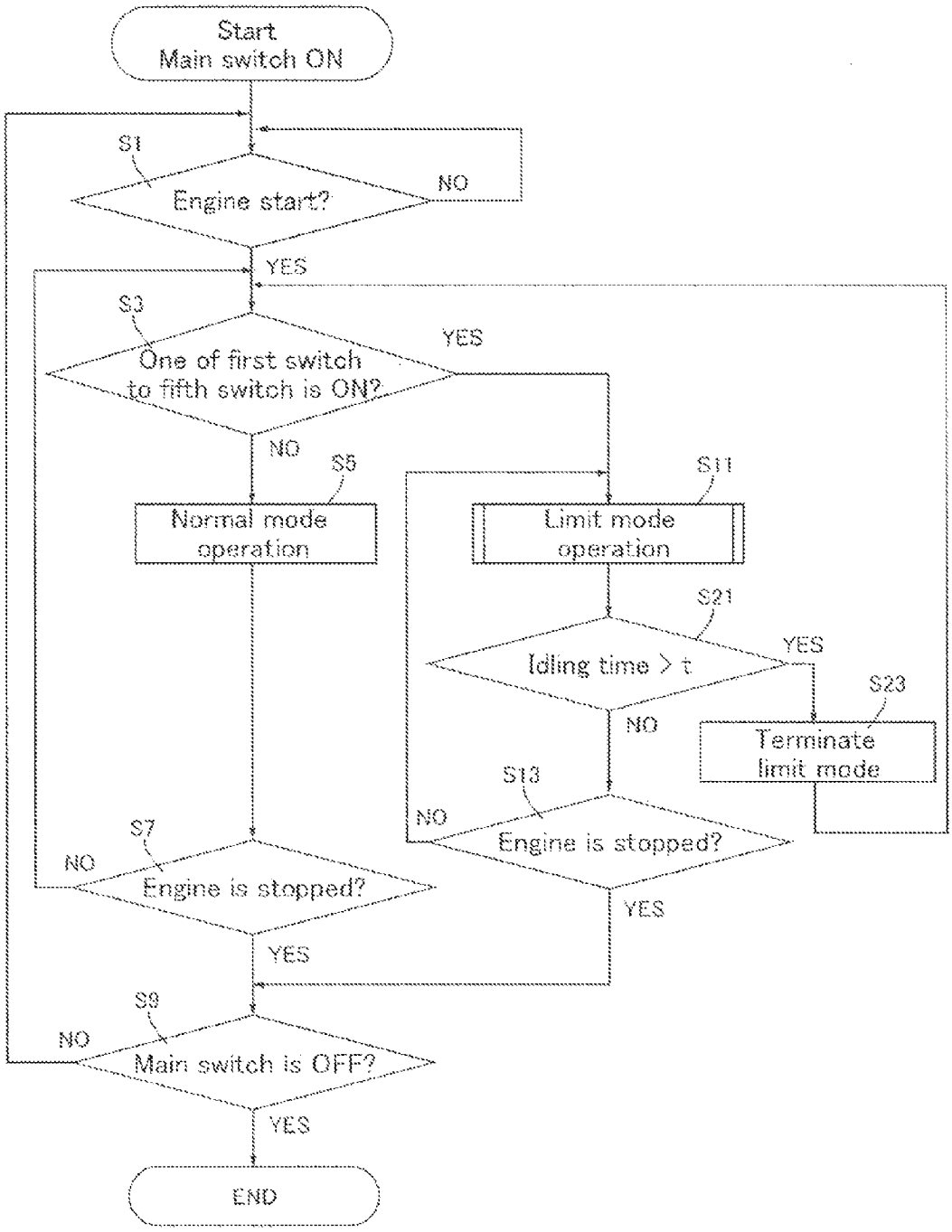
FIG. 11 is a flowchart showing a modified example of a step of terminating the limit mode operation.

FIG. 11 is a flowchart showing a modified example of a step of terminating the limit mode. In this modified example of FIG. 11, in step S21 following step S11, it is determined whether or not the idling time is longer than the predetermined time "t," in the middle of the limit mode operation. If it is determined as YES in step S21, the limit mode is terminated in step S23. After that, the process returns to step S3. On the other hand, if it is determined as NO in step S21, the process goes to step S13. In this modified example, when the engine E (FIG. 1) is not stopped, but a state (idling state) in which the watercraft 10 (FIG. 1) is not substantially operated continues for a period of time longer than the predetermined time "t," the limit mode can be terminated.

Although in the present embodiment, the step (step S17) of reducing the driving power of the engine E and the step (step S19) of adjusting the inclination angle α (FIG. 10) of the ejecting nozzle 36 are executed concurrently in the limit mode operation of FIG. 8, only the step (step S17) of reducing the driving power of the engine E may be executed, or only the step (step S19) of adjusting the inclination angle α (FIG. 10) of the ejecting nozzle 36 may be executed.

As shown in FIG. 2, in the present embodiment, one first switch 80, one fourth switch 86, two second switches 82, two third switches 84, and two fifth switches 88 are provided. However, the number of these switches may be changed suitably. Or, all of the switches 80 to 88 are not necessarily provided. For example, the second switches 82 and the fifth switches 88 may be omitted. In a case where the second switches 82 and the fifth switches 88 are omitted, it is determined whether or not at least one of the first switch 80, the third switches 84, and the fourth switch 86 is in an ON-state in step S3 of FIG. 7.

Figure 12:
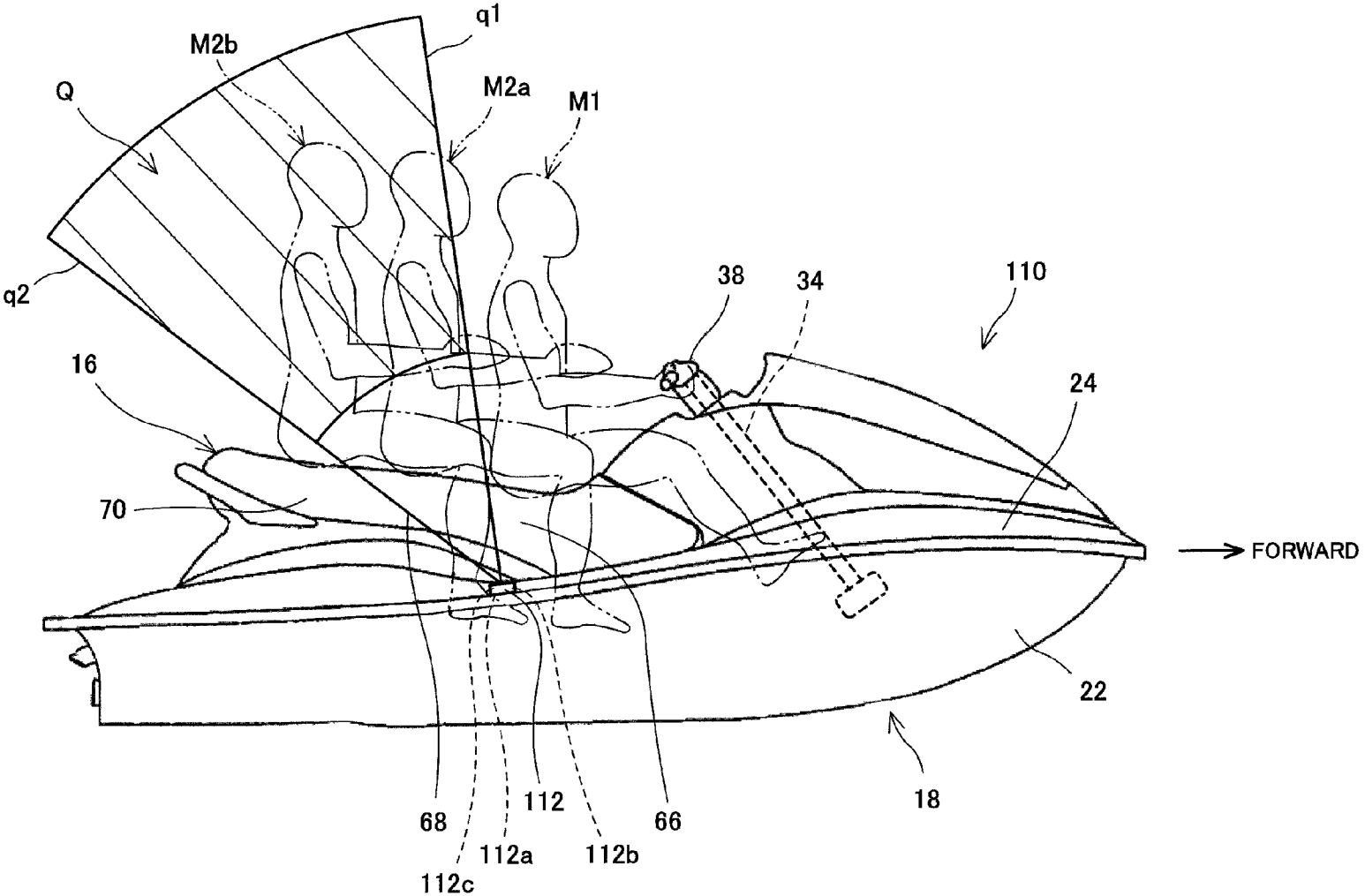
FIG. 12 is a side view showing an external appearance of a personal watercraft according to another embodiment of the present invention.

FIG. 12 is a side view showing an external appearance of a watercraft 110 according to another embodiment. Referring to FIG. 12, the watercraft 110 includes a sensor 112 (non-contact sensor) for detecting the passenger M2*a*, M2*b* in a non-contact state instead of or in addition to the switches 80-88 of FIG. 2. The sensor 112 includes a light emitting section 112*a* for emitting an infrared ray, a light receiving section 112*b* for receiving the infrared ray reflected on the passenger M2*a*, M2*b*, and a detecting (sensing) section 112*c*. The light emitting section 112*a* and the light receiving section 112*b* are disposed on the side surface of the body 18 in locations below a rear end portion of the first seat section 66 or a front end portion of the second seat section 68 such that the infrared ray is not blocked by the second seat section 68. The detecting section is disposed inside of the body 18.

The light emitting section 112*a* is configured to emit the infrared ray toward a sensing region Q of the sensor 112 all the time. When the body 18 is viewed from a side, the sensing region Q has a sector shape expanding from the sensor 112 in a rearward direction and in an upward direction. A front edge q1 of the sensing region Q extends vertically or is slightly inclined in a rearward direction with respect to a vertical direction such that the infrared ray does not contact the driver M1. A rear edge q2 of the sensing region Q extends in a rearward direction and in an upward direction in a region where a hip of the rear passenger M2*b* is located or behind the region where the hip of the rear passenger M2*b* is located such that the infrared ray contacts the passenger M2*a*, M2*b*. In a case where it is supposed that the rear passenger M2*b* does not ride on the watercraft 110, the rear edge q2 of the sensing region Q may extend in the rearward direction and in the upward direction in a region where a hip of the front passenger M2*a* is located or behind the region where the hip of the front passenger M2*a* is located.

The light receiving section 112*b* is configured to receive the infrared ray reflected on the passenger M2*a*, M2*b* in the sensing region Q.

The detecting section 112*c* is configured to output a detection signal indicating presence of the passenger M2*a*, M2*b* based on the infrared ray received by the light receiving section 112*b*. In the present embodiment, the detecting section is configured to output the detection signal based on the infrared ray having an intensity within a predetermined range, of the infrared ray received by the light receiving section 112*b*. If the intensity of the infrared ray received by the light receiving section 112*b* is too low, this infrared ray may have been reflected on an obstacle other than the passenger M2*a*, M2*b*. In this case, the detecting section does not output the detection signal. On the other hand, if the intensity of the infrared ray received by the light receiving section 112*b* is too high, this infrared ray may have been reflected on the driver M1. In this case, the detecting section does not output the detection signal. Therefore, the sensing region Q in which the sensor 112 detects the passenger M2*a*, M2*b* is a particular region indicated by oblique lines in FIG. 12.

Alternatively, the sensor for detecting the passenger M2*a*, M2*b* in the non-contact state may be a sensor using light (e.g., laser light) other than the infrared ray, a sensor using an ultrasonic wave, etc. In these cases, the passenger M2*a*, M2*b* can be detected in the non-contact state based on the laser light or the ultrasonic wave reflected on the passenger M2*a*, M2*b*.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

a body including a hull and a deck covering the hull from above, the hull having a water intake on a bottom portion thereof;

a water jet pump including an ejecting nozzle, the water jet pump being configured to suction water through the water intake and eject the water through an outlet port of the ejecting nozzle;

an engine for actuating the water jet pump;

an ejecting direction adjusting device for adjusting an ejecting direction of the water ejected from the water jet pump;

a driver seat section provided on the deck and configured to accommodate a driver seated on and straddling the driver seat section;

a passenger seat section provided on the deck in a location behind the driver seat section, the passenger seat section being configured to accommodate a passenger seated on and straddling the passenger seat section;

a sensor for detecting whether the passenger is seated on the passenger seat section;

a controller for controlling the engine; and a limit mode terminating section for terminating a limit mode in which a driving power of the engine is reduced;

wherein the controller is configured to control the engine in the limit mode to reduce the driving power of the engine, if the sensor detects that the passenger is seated on the passenger seat section; and wherein the controller controls the engine in the limit mode during a period of time that passes until the limit mode terminating section terminates the limit mode after it is determined that the engine is stopped, if the sensor subsequently does not detect the passenger seated on the passenger seat section after the sensor has previously detected that the passenger was seated on the passenger seat section.

2. The personal watercraft according to claim 1, wherein the passenger seat section is configured to deform downwardly under a weight of the passenger when the passenger is seated on the passenger seat section; and wherein the sensor is placed between the deck and the passenger seat section to detect whether the passenger seat section is deformed.

3. The personal watercraft according to claim 2, wherein the sensor is attached to the deck.

4. The personal watercraft according to claim 1, wherein the sensor is a pressure-sensitive sensor for detecting a pressure applied by the passenger.

5. The personal watercraft according to claim 1,
wherein the sensor is a non-contact sensor for detecting the passenger in a non-contact state.

6. The personal watercraft according to claim 5, wherein the sensor includes:
a light emitting section for emitting light;
a light receiving section for receiving the light reflected on the passenger; and
a detecting section for outputting a detection signal indicating presence of the passenger based on the light received by the light emitting section.

7. The personal watercraft according to claim 6,
wherein the detecting section is configured to output a detection signal based on the light having an intensity within a predetermined range, of the light by the light received by the light receiving section.

8. A personal watercraft comprising:
a body including a hull and a deck covering the hull from above, the hull having a water intake on a bottom portion thereof;
a water jet pump including an ejecting nozzle, the water jet pump being configured to suction water through the water intake and eject the water through an outlet port of the ejecting nozzle;
an engine for actuating the water jet pump;
an ejecting direction adjusting device for adjusting an ejecting direction of the water ejected from the water jet pump;
a driver seat section provided on the deck and configured to accommodate a driver seated on and straddling the driver seat section;
a passenger seat section provided on the deck in a location behind the driver seat section, the passenger seat section being configured to accommodate a passenger seated on and straddling the passenger seat section;
a sensor for detecting whether the passenger is seated on the passenger seat section;
a controller for controlling the ejecting direction adjusting device; and
a limit mode terminating section for terminating a limit mode in which the outlet port of the ejecting nozzle is caused to face in an obliquely downward direction;
wherein the controller is configured to control the ejecting direction adjusting device in the limit mode such that the outlet port of the ejecting nozzle faces in the obliquely downward direction, if the sensor detects that the passenger is seated on the passenger seat section; and
wherein the controller controls the ejecting direction adjusting device in the limit mode during a period of time that passes until the limit mode terminating section terminates the limit mode, if the sensor does not detect the passenger seated on the passenger seat section after the sensor detected the passenger.

9. The personal watercraft according to claim 8,
wherein the controller is configured to control the engine to reduce a driving power of the engine, if the sensor detects that the passenger is seated on the passenger seat section.

10. The personal watercraft according to claim 8,
wherein the passenger seat section is configured to deform downwardly under a weight of the passenger when the passenger is seated on the passenger seat section; and
wherein the sensor is placed between the deck and the passenger seat section to detect whether the passenger seat section is deformed.

11. The personal watercraft according to claim 10,
wherein the sensor is attached to the deck.

12. The personal watercraft according to claim 8,
wherein the sensor is a pressure-sensitive sensor for detecting a pressure applied by the passenger.

13. The personal watercraft according to claim 8,
wherein the sensor is a non-contact sensor for detecting the passenger in a non-contact state.

14. The personal watercraft according to claim 13,
wherein the sensor includes:
a light emitting section for emitting light;
a light receiving section for receiving the light reflected on the passenger; and
a detecting section for outputting a detection signal indicating presence of the passenger based on the light received by the light emitting section.

15. The personal watercraft according to claim 14,
wherein when viewed from a side, a sensing region of the sensor has a sector shape expanding from the sensor in a rearward direction and in an upward direction, and
the light emitting section and the light receiving section are disposed on a side surface of the body in locations below a rear end portion of the driver seat section or a front end portion of the passenger seat section such that the light is not blocked by the passenger seat section.

16. A personal watercraft comprising:
a body including a hull and a deck covering the hull from above, the hull having a water intake on a bottom portion thereof;
a water jet pump including an ejecting nozzle, the water jet pump being configured to suction water through the water intake and eject the water through an outlet port of the ejecting nozzle;
an engine for actuating the water jet pump;
an ejecting direction adjusting device for adjusting an ejecting direction of the water ejected from the water jet pump;
a driver seat section provided on the deck, a driver being seated on the driver seat section such that the driver straddles the driver seat section;
a passenger seat section provided on the deck in a location behind the driver seat section, a passenger being seated on the passenger seat section such that the passenger straddles the passenger seat section;
a controller for controlling the engine;
a sensor, wherein the sensor is a non-contact sensor for detecting the passenger seated on the passenger seat section, the sensor including:
a light emitting section for emitting light;
a light receiving section for receiving the light reflected from the passenger; and
a detecting section for outputting a detection signal indicating a presence of the passenger based on the light received by the light receiving section; and
wherein when viewed from a side, a sensing region of the sensor has a sector shape expanding from the sensor in a rearward direction and in an upward direction, and
the light emitting section and the light receiving section are disposed on a side surface of the body in locations below a rear end portion of the driver seat section or a front end portion of the passenger seat section such that the light is not blocked by the passenger seat section.

17. A personal watercraft comprising:
a body including a hull and a deck covering the hull from above, the hull having a water intake on a bottom portion thereof;

a water jet pump including an ejecting nozzle, the water jet pump being configured to suction water through the water intake and eject the water through an outlet port of the ejecting nozzle;

an engine for actuating the water jet pump;

an ejecting direction adjusting device for adjusting an ejecting direction of the water ejected from the water jet pump;

a driver seat section provided on the deck, a driver being seated on the driver seat section such that the driver straddles the driver seat section;

a passenger seat section provided on the deck in a location behind the driver seat section, a passenger being seated on the passenger seat section such that the passenger straddles the passenger seat section;

a controller for controlling the engine;

a sensor, wherein the sensor is a non-contact sensor for detecting the passenger seated on the passenger seat section, the sensor including:

a light emitting section for emitting light;

a light receiving section for receiving the light reflected from the passenger; and a detecting section for outputting a detection signal indicating a presence of the passenger based on the light received by the light receiving section; and wherein when viewed from a side, a sensing region of the sensor has a sector shape expanding from the sensor in a rearward direction and in an upward direction, and a front edge of the sensing region extends vertically or is slightly inclined in a rearward direction with respect to a vertical direction such that the light does not contact the driver.

18. The personal watercraft according to claim 17, wherein a rear edge of the sensing region extends in a rearward direction and in an upward direction in a region where a hip of the passenger is located or behind the region where the hip of the passenger is located such that the light contacts the passenger.

* * * * *